United States Patent [19]

Kowalchuk

[11] 4,137,197

[45] Jan. 30, 1979

[54] POWDERED DETERGENT COMPOSITIONS CONTAINING A CALCIUM SALT OF AN ANIONIC SURFACTANT

[75] Inventor: John Kowalchuk, Palisades Park, N.J.

[73] Assignee: Lever Brothers Company, New York, N.Y.

[21] Appl. No.: 850,321

[22] Filed: Nov. 10, 1977

[51] Int. Cl.[2] ..... C11D 1/83; C11D 1/12; C11D 3/065

[52] U.S. Cl. ..... 252/532; 252/89 R; 252/135; 252/531; 252/535; 252/536; 252/539; 252/540; 252/550; 252/551; 252/554; 252/555; 252/558; 252/559

[58] Field of Search ..... 252/540, 559, 531, 532, 252/535, 536, 550, 551, 554, 555, 135, 89 R, 558, 539

[56] References Cited

U.S. PATENT DOCUMENTS

| | | | |
|---|---|---|---|
| 3,867,317 | 2/1975 | Woo et al. | 252/555 |
| 3,925,224 | 12/1975 | Winston | 252/540 X |
| 3,951,879 | 4/1976 | Wixon | 252/528 X |
| 3,998,750 | 12/1976 | Payne et al. | 252/108 |
| 4,017,409 | 4/1977 | Demessemaekers et al. | 252/531 X |
| 4,049,586 | 9/1977 | Collier | 252/532 |

*Primary Examiner*—Harris A. Pitlick

*Attorney, Agent, or Firm*—Kenneth F. Dusyn; James J. Farrell; Melvin H. Kurtz

[57] ABSTRACT

The present invention relates to an improved mechanically mixed, non-spray dried, built laundry detergent composition comprising the calcium salt of a non-soap, organic, anionic surface active agent, an ethoxylated alcohol nonionic surfactant, and an alkali metal salt of a phosphate sequesterant builder compound.

25 Claims, No Drawings

POWDERED DETERGENT COMPOSITIONS CONTAINING A CALCIUM SALT OF AN ANIONIC SURFACTANT

FIELD OF THE INVENTION

This invention relates to mechanically mixed, non-spray dried, built, powdered laundry detergent compositions containing (a) a calcium salt of a non-soap, organic, anionic surfactant, in particular, the calcium alcohol sulfates, linear alkane sulfonates, olefin sulfonates, linear alkyl benzene sulfonates, and alcohol ethoxy (1-6EO) sulfates; (b) an ethoxylated alcohol nonionic surfactant; and (c) an alkali-metal salt of a phosphate sequesterant builder compound. The detergent compositions according to the invention possess good processing and detergency characteristics, and excellent cold water detergency performance. The composition may additionally include non-phosphorous sequestering builder compounds.

BACKGROUND

The preparation of powdered detergent formulations by mechanical mixing methods based on the sodium salt of anionic surfactants and certain nonionic surfactants in the past has generally led to poor powder processing characteristics of the detergent formulation.

The poor processing characteristics of these detergent formulations have been due to a variety of reasons, among which, for example, is that an excessive amount of water is usually associated with the anionic component of the detergent formulation and the hygroscopic nature of the surfactants themselves. Also incompatability of the nonionic surfactant with the electrolyte or builder component of the formulation has led to "bleeding" of the nonionic surfactant into a separate phase on the surface of the solid particles.

The importance of preparing these detergent formulations by mechanical means is becoming increasingly important because of the low energy requirements and cost savings that are realized as compared to other means of preparing anionic, nonionic, and mixed powdered detergent formulations known in the art. Previous attempts at overcoming the aforementioned problems have included the addition of processing aids, for example, clays, which act as absorbents for the organic components in the formulations (Netherlands Pat. No. 7,413,521). Applicant has surprisingly discovered, however, that a much better approach in overcoming the processing problems of these nonionic based, powdered detergent formulations is by the use of the calcium salts of non-soap organic, anionic detergent surfactants in the formulations. Unexpectedly, these calcium salts do not significantly lower the detergent properties of the powder formulations relative to the corresponding formulation utilizing the sodium salt of the anionic surfactant.

The use of alkali metal salts of anionic surfactants in detergent compositions to improve the detergency benefits thereof has been cited in various publications known in the prior art. Examples of the prior art are as follows:

U.S. Pat. Nos. 2,908,651 issued on Oct. 13, 1959; 2,691,636 issued on Oct. 12, 1954; 2,766,212 issued on Oct. 9, 1956; 3,718,609 issued on Feb. 23, 1973; 3,686,098 issued on Aug. 22, 1972; 2,437,253 issued on Mar. 9, 1948; and Australian Pat. No. 18/76 published July 21, 1976.

Applicant has discovered, however, that the selection of the calcium salt of certain organic, synthetic, non-soap anionic surfactants in combination with a selected class of nonionic surfactants and the alkali metal salt of a phosphate sequestering builder compound, has a significant effect in the preparation of powdered detergent formulations by mechanical means, while at the same time increasing the cold water detergency of such formulations as well as maintaining the overall detergency properties thereof. The prior art fails to recognize the problems encountered with mechanically mixed, nonionic based detergent products, and how they may be overcome. It is an object of the present invention, therefore, to provide mechanically mixed, powdered detergent compositions in an efficient manner and which will overcome the problems known heretofore in their manufacture, while at the same time maintaining good detergency properties, especially in regard to cold water detergency performance.

All percentages are expressed by weight unless otherwise specified.

DETAILED DESCRIPTION OF THE INVENTION

The present invention relates to the mechanically mixed, non-spray dried, powdered laundry detergent composition comprising as the essential ingredients: (a) from about 4% to about 20% of the calcium salt of a non-soap, organic anionic surfactant, in particular, the calcium alcohol sulfates, alcohol ethoxy (1-6EO units) sulfates, linear alkane sulfonates, olefin sulfonates and linear alkylbenzene sulfonates (LAS), or mixtures thereof; (b) from about 4% to about 20% of an ethoxylated alcohol nonionic surfactant; and (c) from about 5% to about 70% of an alkali-metal salt, preferably sodium or potassium, of a phosphate sequestering builder compound, in particular the tripolyphosphates and pyrophosphates, the percentages being based on the total weight of the composition. The detergent composition according to the invention possesses good processing and detergency characteristics, and excellent cold water detergency performance. The composition may additionally include weak, non-phosphorous sequestering builder compounds.

Applicant has surprisingly and unexpectedly found that desireable effects could be obtained with a detergent formulation containing a calcium salt of a non-soap, organic anionic surfactant and an ethoxylated alcohol nonionic surfactant. This is especially true when it has been heretofore considered that calcium acts as a detriment to detergency, and that the calcium salt of an anionic surfactant generally has low solubility in an aqueous medium. While not desiring to be held to any particular theory, it is thought that the calcium salt of the anionic surfactant dissolves in the micelles of the nonionic surfactant. Thus, when the phosphate builder compound is present, the calcium ions in the solid lattice structure of the insoluble salt are much more difficult to remove than those calcium ions present in the aqueous double layer of the mixed anionic/nonionic micelle. In any event, these occurrences lead to an efficient softening of the water and efficient detergent properties for the wash solution. It should be noted that the processing characteristics of such a detergent formulation is further enhanced by the fact that the calcium salts of the anionic surfactants according to the invention are readily prepared since they are relatively insoluble in water and can be easily filtered from aqueous solutions. This is in contrast to the sodium salts of the respective surfactants which are generally hygroscopic and at the very least water soluble. As such they cannot be readily isolated in dry form except in admixture with large amounts of inorganic electrolyte salts.

Of particular importance in the detergent composition is the calcium salt of the synthetic, organic, non-soap, anionic surfactant, in particular, the calcium alkyl sulfates, calcium linear alkane sulfonates (or paraffin sulfonates), the calcium olefin sulfonates, the calcium linear alkylbenzene sulfonates, and the calcium alcohol ethoxy (1-6EO units) sulfates.

As part of the synthetic anionic class of compounds forming this component of the detergent composition, they include the calcium salts of organic sulfuric reaction products having in their molecular structure an alkyl group containing from about 8 to 22 carbon atoms and a sulfuric acid ester group. Examples of this group of synthetic detergents are the calcium alkyl sulfates, especially those obtained by sulfating the higher alcohols ($C_8$–$C_{18}$ carbon atoms) produced by reducing the glycerides of tallow or coconut oil.

Particularly good cold water detergency is acheived when the $C_{12}$–$C_{14}$ alkyl sulfates are used, especially the $C_{14}$ alcohol sulfates The calcium alcohol ethoxy sulfates (or alkyl ether sulfates) have the formula $RO(C_2H_4O)_xSO_3Ca$ wherein R is alkyl or alkenyl of about 10 to about 20 carbon atoms and $x$ is 1 to 6, preferably 1 to 3. These sulfates are condensation products of ethylene oxide and monohydric alcohols having about 10 to about 20 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 6 molar proportions of ethylene oxide and the resulting mixture is sulfated and neutralized.

Specific examples of the alcohol ethoxy sulfates include calcium sodium coconut alkyl ethylene glycol ether sulfate; calcium tallow alkyl triethylene glycol ether sulfate; calcium tallow alkyl hexaoxyethylene sulfate; calcium $C_{14}$–$C_{16}$ alkyl glycol ether sulfate; and calcium $C_{10}$–$C_{20}$ alkyl triethylene glycol ether sulfate.

The preferred "olefin sulfonate" detergent mixtures utilizable herein comprise olefin sulfonates containing from about 10 to about 24 carbon atoms. Such materials can be produced by the sulfonation of $\alpha$-olefins by means of uncomplexed sulfur trioxide followed by neutralization under conditions such that any sultones present are hydrolyzed to the corresponding hydroxyalkane sulfonates. The $\alpha$-olefin starting materials preferably have from 14 to 16 carbon atoms. The preferred $\alpha$-olefin sulfonates are described in U.S. Pat. Nos. 3,332,880 and 4,040,988, incorporated herein by reference.

The paraffin sulfonates included in the anionic class of surfactants are essentially linear and randomly distributed, and contain from 8 to 24 carbon atoms, preferably 12 to 20, and desireably 14 to 18 carbon atoms in the alkyl radical. An example of a paraffin sulfonate is that which is available from Henckel and Cie under the tradename "Hostapur SAS-60" (Sodium $C_{13}$–$C_{18}$ paraffin sulfonate).

The amount of anionic surfactant in the form of the calcium salt present in the composition may vary from about 4% to about 20% although it is preferred that from 8% to about 12% be present.

The nonionic surfactant component included in the composition in accordance with the invention is of the ethoxylated alcohol type having the following formula:

$$RO(C_2H_4O)_nH$$

wherein R is an alkyl, alkenyl or alkaryl group having 8 to 20 carbon atoms, preferably 12 to 18 carbon atoms; and $n$ is an integer from 4 to 30 preferably from 4 to 15, and most desireably from 6 to 12.

The nonionic surfactants that may be included are condensation products of a long chain ethylene oxide moiety with a primary alcohol, secondary alcohol or alkyl phenol. Thus, R is a straight or branched chain hydrocarbyl moiety derived from a primary or secondary alcohol containing 8 to 20 carbon atoms, preferably 10 to 15 carbon atoms, or an alkyl pheonol-based moiety where the alkyl chain is straight or branched and contains 6 to 12 carbon atoms, preferably 6 to 9 carbon atoms.

Illustrative nonionic surfactants having the desired characteristics for formulationg mechanically mixed, non-spray dried, powdered detergent compositions are available on the market under the tradename of "Neodol" products by Shell Oil Company; "Tergitol" products by Union Carbide Company; and "Alfol" products by Continental Oil Company. Specific examples include "Neodol 25-7" (linear $C_{12}$–$C_{15}$ primary alcohol condensed with 7 moles of ethylene oxide per mole of alcohol); "Tergitol 15-S-7" (random secondary $C_{11}$–$C_{15}$ alcohol condensed with 7 moles of ethylene oxide per mole of alcohol); and "Alfol 1416-6.5" (primary $C_{14}$–$C_{16}$ alcohol condensed with 6.5 moles of ethylene oxide per mole of alcohol).

The amount of nonionic surfactant present in the composition may range from about 4% to about 20%, preferably from 8% to 12%. From the standpoint of consistency and storage characteristics of the powdered formulations herein, it is desired to maintain the level of the anionic component greater than that of the nonionic component in the composition. A ratio of anionic to nonionic of 3:2 is preferred although a greater or lesser range may be used, for example, 2.5–4.0:2.0, depending upon the desired characteristics of the end product. This is not to say, however, that the level of nonionic may not exceed that of the anionic in the composition for the purposes of operability.

The builder component of the invention is of the strong sequestering type, i.e., a phosphate sequesterant builder compound. These compounds include the alkali metal tripolyphosphates and pyrophosphates, or mixtures thereof. Sodium and potassium are the preferred alkali-metal salts.

In addition to the phosphate sequestering type builder compounds, non-phosphorous, water-soluble sequestering builder compounds may be added to the composition as an adjunct thereto. For example, the alkali metal, ammonium and substituted ammonium polyacetates, carboxylates, polycarboxylates, and polydroxysulfonates are useful sequestering builders in the present compositions. Specific examples of the polyacetate and polycarboxylate builder salts include sodium, potassium, lithium, magnesium, ammonium, and substituted ammonium salts of ethylene diamine tetraccetic acid, nitrilotriacetic acid, oxydisuccinic acid, mellitic acid, benzene polycarboxylic acids, and carboxymethoxysuccinic acid, and citric acid.

Highly preferred non-phosphorus sequestering builder materials herein include sodium citrate, sodium oxydisuccinate, sodium carboxymethoxysuccinate, sodium mellitate, sodium nitrilotriacetate, and sodium ethylene diamine tetraacetate and mixtures thereof.

Other preferred non-phosphorous, sequestering builder compounds included herein are the polycarboxylate builders set forth in U.S. Pat. No. 3,308,067 to Diehl, incorporated herein by reference. Examples of such materials include the water soluble salts of the homo- and co-polymers of aliphatic carboxylic acids such as maleic acid, itaconic acid, mesaconic acid, fumaric acid, aconitic acid, citraconic acid, methylenemalonic aicd, 1,1,2,2-ethane tetracarboxylic acid, dihydroxy tartaric acid, and keto-malonic acid.

Additional preferred non-phosphorous sequestering builder compounds herein include the water soluble salts, especially the sodium and potassium salts, of carboxymethyloxymalonate, cis-cyclohexanehexacarboxylate, cis-cyclopentanetetracarboxylate, and phloroglucinol trisulfonate.

Other builder compounds include non-phosphorous, crystalline and amphorous zeolytes such as those described in Netherlands Pat. No. 7,511,455 published Apr. 6, 1976, and in German Patent OLS No. 2,433,485 published Feb. 6, 1975, which patents are incorporated herein by reference.

The amount of phosphate sequestering builder compound present in the detergent composition may generally range from about 5% to about 70% preferably from about 10% to about 60% and most desireably from about 25% to about 50%. When the non-phosphorous water-soluble sequestering builder compounds are added to the already present phosphate builder compound of the detergent composition, it is done so in an amount that will not exceed about 20%, and usually in the range from about 5% to about 15% depending on the nature and strength of the non-phosphorous sequestering builder compound used.

Other materials which may be present in the detergent compositions of the invention are those conventionally present therein. Typical examples thereof include soil suspending agents, hydrotropes, corrosion inhibitors, dyes, perfumes, fillers, abrasives, optical brighteners, enzymes, suds boosters, suds depressants, germicides, anti-tarnishing agents, cationic detergents, softeners, chlorine releasing agents, buffers and the like. The balance of the detergent compositions is water.

The granular detergent compositions herein may also optionally contain processing aids, e.g. sodium sulfate. When an anticorrosion agent is used, it is preferred to use the sodium silicates containing a $SiO_2$:$Na_2O$ ratio of about 1:1 to about 3:75:1, e.g. Ru silicate ($SiO_2$:$Na_2O$ = 2.4:1) and Britesil H-24 ($SiO_2$:$Na_2O$ = 2.4:1).

The relative effectiveness of the compositions of the present invention is determined by actual wash performance in varying degrees of water hardness conditions, and by the actual flow characteristics of the powdered composition after its manufacture. The consistencies and flow characteristics of the composition are measured in terms of the descriptions given in Table A listed below, with each described condition being rated as "acceptable", "borderline acceptable" and "not acceptable". Each of the examples that are present hereinafter are rated according to the designation assigned to each of the descriptions given in Table A.

TABLE A

| | Flow Characteristics Description |
|---|---|
| * | A - Dry free flowing; not dusty - A-1 free flowing nondusty slight wicking<br>A-2 free flowing nondusty severe wicking |
| * | B - Dry free flowing; dusty |
| *** | C - Packed; waxy; does not flow |
| ** | D - very slightly damp; initially packed; free flowing after slight rapping |
| * | E - Dry; initially packed; can be broken up |
| * | F - Slightly damp; free flowing |
| *** | G - Damp botton; initially packed; top free flowing |
| *** | H - Tacky, crumbly, granular: H-1 damp granular - high levels of $Na_2SO_4$ are detrimental |
| * | I - free flowing but can absorb more water |
| * | J - Good, smooth powder; little dust |
| *** | K - Slurry |
| * | L - Slight lumping |
| * | M - Dusty free flowing bead |
| ** | N - Dusty, tacky; partially free flowing bead; N-1 Dusty, tacky, partially free flowing; compressible |
| * | O - Very dusty; compressible |
| * | P - Dusty; compressible; P-1 good powder properties, but compressible |
| *** | Q - Very moist; not a powder |
| *** | R - Creepy with small lumps; pourable |
| *** | S - Clumped together |
| * | T - Dusty; mostly free flowing with bumps |
| * | U - Dry; free flowing; large lumps |
| ** | V - Granular, free flowing; slightly damp |
| ** | W - Very slightly damp, free flowing; granular |
| * | X - Dusty; free flowing; medium lumps |
| *** | Y - Lumpy, creepy; poor powder properties |
| *** | Z - Creepy; very tacky bead; compressible |

* - acceptable
** - borderline acceptable
*** - not acceptable.

The mixing procedure and order of addition of the detergent components according to the present invention are as follows: All materials are blended in a standard "Kitchenaid" mixer (Model No. 4C) at a slow speed setting (No. 1 setting). The dry components are added to the mixer first and allowed to co-mingle for approximately five minutes. While the mixing takes place, the liquid components are added, with the nonionic surfactant being added last. The total mixture is allowed to be mixed for approximately 10 additional minutes. The flow characteristics of the finished composition are then determined before the product is utilized in a wash.

The cleansing ability or detergency of the detergent formulations are determined with a Terg-O-Tometer. In the testing of the examples that follow, the four pots of the Terg-O-Tometer are first filled with 1000 ml of water of the desired hardness (e.g. 60 ppm, 120 ppm or 240 ppm, calculated as calcium carbonate; 2:1 $Ca^{++}/Mg^{++}$) at the desired temperature (e.g. 120° F. or 80° F.). Next, 1.0 or 2.0 grams each of four test formulations are dissolved in the respective volumes of water to product 0.1% or 0.2% formulation concentrations. Then, four pieces of 4½ inch by 6 inch dacron (65%)-cotton (35%) clothes (referred to herinafter as D/C VCD) soiled with a particulate/oily soil are added and the cloth is washed for 10 minutes at a paddle oscillation rate of 90 cycles per minute. The cloth is then squeezed by hand and rinsed for 1 minute in fresh water (same volume and hardness as initially used; rinse temperature is 100° F. for runs in which 120° F. washing is used and 80° F. for runs in which 80° F. washing is used). The cloth is again squeezed by hand to remove excess water and dried in a commerical clothes dryer. The reflectance of the cloth is measured by a Gardner Color Difference Meter Model XL10. The detergency of the formulation is expressed as %Detergency and is calculated from the following expression:

$$\% \text{ Detergency} = \frac{\text{Reflectance of washed cloth} - \text{Reflectance of soiled cloth before washing}}{\text{Reflectance of clean cloth before soiling} - \text{Reflectance of soiled cloth before washing}} \times 100\%$$

The following examples serve to demonstrate the invention herein.

EXAMPLE 1

| Components | 1 |
|---|---|
| $CaC_{16}$ Alcohol Sulfate | 12.0% |
| Neodol 25-7 | 8.0% |
| Ru Silicate | 10.0% |
| Na Tri-Polyphosphate | 29.0% |
| Na Citrate | — |
| $Na_2CO_3$ | — |
| CMC (carboxymethylcellulose) | 0.5% |
| $Na_2SO_4$ | Balance |
| Water | 5.0% |
| % Detergency 60 ppm | 33.5% |
| % Detergency 120 ppm | 32.2% |
| % Detergency 240 ppm | 28.9% |
| Flow characteristics | E |
| % $H_2O$ (in total weight) | 14.7% |

Washing conditions: D/C VCD, 120° F; 60, 120, 240 ppm (2:1 $Ca^{++}/Mg^{++}$) water at 0.15 product concentration

EXAMPLES 2–3

| Components | 2 | 3 |
|---|---|---|
| $CaC_{16}$ Alcohol Sulfate | 12.0% | — |
| $NaC_{16}$ Alcohol Sulfate | — | 12.0% |
| Neodol 25-7. | 8.0% | 8.0% |
| Ru Silicate Solids | 10.0% | 10.0% |
| Na Tripolyphosphate | 29.0% | 29.0% |
| CMC (Carboxymethylcellulose) | 0.5% | 0.5% |
| $Na_2SO_4$ | balance | balance |
| Water | 5.0% | 5.0% |
| % Detergency 60 ppm | 33.5% | 35.3% |
| % Detergency 120 ppm | 32.2% | — |
| % Detergency 180 ppm | — | 30.6% |
| % Detergency 240 ppm | 28.9% | — |
| Flow characteristics | E | E |
| % $H_2O$ (in total weight) | 14.7% | 14.7% |

Washing condition: D/C VCD cloth; 120° F; Example 2 at 60,120,240 ppm, Example 3 at 60, 180 ppm; (2:1 $Ca^{++}/Mg^{++}$) water; Example 2 at 0.15% product concentration; Example 3 at 0.12% product concentration.

EXAMPLES 4–5

| Components | 4 | 5 |
|---|---|---|
| $CaC_{16}$ Alcohol Sulfate | 12.0% | — |
| Britesil H-20 | — | 15.0% |
| Ru Silicate | 10.0% | — |
| Na Tripolyphosphate | 33.0% | 25.0% |
| $Na_2SO_4$ | balance | balance |
| Water | 15.91% | 10.0% |
| Neodol 25-7 | 8.0% | 8.0% |
| Dicalite (Diatomaceous earth) | — | 3.0% |
| % Detergency 60 ppm | 35.1% | 39.3% |
| % Detergency 120 ppm | 33.8% | — |
| % Detergency 180 ppm | — | 33.9% |
| % Detergency 240 ppm | 33.2% | — |
| Flow characteristics | A-1 | A-2 |

Washing conditions: D/C VCD cloth; 120° F; Example 4 in 60,120,240 ppm and Example 5 in 60 and 180 ppm (2:1 $Ca^{++}/Mg^{++}$) water at a 0.2% product concentration.

EXAMPLES 6–9

| Components | | 6 | 7 | 8 | 9 |
|---|---|---|---|---|---|
| $CaC_{16-18}$Alcohol Sulfate | | — | 12.0% | 8.0% | 20.0% |
| Na Tripolyphosphate | | 33.0% | 33.0% | 33.0% | 33.0% |
| $Na_2SO_4$ | | balance | balance | balance | balance |
| Ru Silicate | | 10.0% | 10.0% | 10.0% | 10.0% |
| Neodol 25-7 | | 20.0% | 8.0% | 12.0% | — |
| 0.1% | % Detergency 60 ppm | 38.5 | 34.2 | 35.8 | 19.4 |
| | % Detergency 120 ppm | 34.2 | 27.6 | 31.7 | 13.4 |
| | % Detergency 240 ppm | 28.9 | 28.8 | 30.8 | 9.3 |
| 0.2% | % Detergency 60 ppm | 44.4 | 40.2 | 41.6 | 27.8 |
| | % Detergency 120 ppm | 41.1 | 36.9 | 37.7 | 20.1 |
| | % Detergency 240 ppm | 34.2 | 31.8 | 34.3 | 16.4 |
| Flow characteristics | | K | M | N | B |
| % $H_2O$ in total weight | | 10.2 | 10.6 | 10.4 | 10.8 |

Washing conditions: D/C VCD cloth; 120° F; 60,120,240ppm (2:1 $Ca^{++}/Mg^{++}$) at both a 0.1% and 0.2% product concentration (Corrected to zero % $H_2O$)

EXAMPLES 10–13

| Components | 10 | 11 | 12 | 13 |
|---|---|---|---|---|
| $CaC_{10-12}$Alcohol Sulfate | 12.0% | — | — | — |
| $CaC_{12-14}$Alcohol Sulfate | — | 12.0% | — | — |
| $CaC_{14-16}$Alcohol Sulfate | — | — | 12.0% | — |
| $CaC_{16-18}$Alcohol Sulfate | — | — | — | 12.0% |
| Sodium Tripolyphosphate | 25.0% | 25.0% | 25.0% | 25.0% |
| Sodium sulfate | balance | balance | balance | balance |
| CMC (carboxymethylcellulose) | 0.5% | 0.5% | 0.5% | 0.5% |
| Ru Silicate | 10.0% | 10.0% | 10.0% | 10.0% |
| Neodol 25-7 | 8.0% | 8.0% | 8.0% | 8.0% |
| % Detergency 60 ppm | 39.6 | 43.3 | 41.2 | 39.9 |
| % Detergency 120 ppm | 34.6 | 40.9 | 38.4 | 37.1 |
| % Detergency 240 ppm | 27.7 | 35.6 | 34.0 | 32.9 |
| Flow characteristics | H-1 | H-1 | H-1 | H-1 |
| % $H_2O$ in total weight | 10.8 | 11.4 | 10.6 | 10.6 |

Washing conditions: D/C VCD cloth; 120° F; 60,120,240 ppm (2:1 $Ca^{++}/Mg^{++}$) water at a 0.2% product concentration (corrected to zero % water).

EXAMPLES 14–15

| Components | 14 | 15 |
|---|---|---|
| $CaC_{13}$—$C_{18}$ paraffin sulfonate | 12.0% | — |
| $NaC_{13}$—$C_{18}$ paraffin sulfonate | — | 12.0% |
| Sodium Tripolyphosphate | 25.0% | 25.0% |
| $Na_2SO_4$ | balance | balance |
| Britesil H-24 | 10.0% | 10.0% |
| Neodol 25-7 | 8.0% | 8.0% |
| % Detergency 60 ppm | 34.5 | 35.2 |
| % Detergency 120 ppm | 32.3 | 34.6 |
| % Detergency 240 ppm | 31.6 | 30.3 |
| Flow characteristics | J | Q |
| % $H_2O$ in total weight | 0.48% | 0% |

Washing conditions: D/C VCD cloth; 120° F; 60, 120, 240 ppm (2:1 $Ca^{++}/Mg^{++}$) water at a 0.2% product concentration.

EXAMPLES 16–19

| Components | 16 | 17 | 18 | 19 |
|---|---|---|---|---|
| Ca LAS (linear $C_{10}$—$C_{15}$ alkylbenzene sulfonate) | 12.0% | — | — | — |
| Na LAS (linear $C_{10}$—$C_{15}$ alkylbenzene sulfonate) | — | 12.0% | — | — |
| $CaC_{16}$Alcohol Sulfate | — | — | 12.0% | — |
| $NaC_{16}$Alcohol Sulfate | — | — | — | 12.0% |
| Neodol 25-7 | 8.0% | 8.0% | 8.0% | 8.0% |
| Na Tripolyphosphate | 25.0% | 25.0% | 25.0% | 25.0% |
| Britesil H-24 | 10.0% | 10.0% | 10.0% | 10.0% |
| $Na_2SO_4$ | balance | balance | balance | balance |
| % Detergency 60 ppm | 41.1 | 41.5 | 42.0 | 44.1 |
| % Detergency 120 ppm | 39.2 | 42.2 | 38.5 | 43.0 |
| % Detergency 240 ppm | 39.6 | 38.6 | 36.4 | 38.5 |
| Flow characteristics | R | S | T | R |
| % $H_2O$ in total weight | 0.58% | 12.9% | 0% | 1.2% |

Washing conditions: D/C VCD cloth; 120° F; 20, 120, 240 ppm (2:1 $Ca^{++}/Mg^{++}$) water at a 0.2% product concentration (corrected to zero % water).

EXAMPLES 20–25

| Components | 20 | 21 | 22 | 23 | 24 | 25 |
|---|---|---|---|---|---|---|
| $CaC_{16-18}$Alcohol Sulfate | 12.0% | 6.0% | 8.0% | 6.0% | 9.0% | 4.0% |
| Neodol 25-7 | 8.0% | 4.0% | 12.0% | 9.0% | 6.0% | 6.0% |
| Ru silicate | 10.0% | 10.0% | 10.0% | 10.0% | 10.0% | 10.0% |
| Na Tripolyphosphate | 25.0% | 25.0% | 25.0% | 25.0% | 25.0% | 25.0% |
| $Na_2SO_4$ | balance | balance | balance | balance | balance | balance |
| % Detergency 60 ppm | 40.8 | 38.8 | 38.9 | 38.4 | 39.7 | 37.4 |
| % Detergency 120 ppm | 38.2 | 36.6 | 37.3 | 38.9 | 38.1 | 35.9 |
| % Detergency 240 ppm | 37.1 | 32.6 | 34.4 | 34.9 | 33.9 | 32.0 |
| Flow characteristics | W | A | V | V | W | A |
| % $H_2O$ in total weight | 10.6% | 10.4% | 10.4% | 10.4% | 10.4% | 10.3% |

Washing conditions: D/C VCD cloth; 120° F; 60,120,240 ppm (2:1 $Ca^{++}/Mg^{++}$) water at a 0.2% product concentration (corrected to zero % water).

EXAMPLES 26–28

| Components | 26 | 27 | 28 |
|---|---|---|---|
| $CaC_{16-18}$Alcohol Sulfate | — | — | 12.0% |
| Ca Linear Alcohol (3-ethylene oxide units) Sulfate | 12.0% | — | — |
| Na Linear Alcohol (3-ethylene oxide units) Sulfate | — | 12.0% | — |
| Neodol 25-7 | 8.0% | 8.0% | 8.0% |
| Ru Silicate | 10.0% | 10.0% | 10.0% |
| Na Tripolyphosphate | 25.0% | 25.0% | 25.0% |
| $Na_2SO_4$ | balance | balance | balance |
| % Detergency 60 ppm | 35.6 | 36.0 | 39.6 |
| % Detergency 120 ppm | 34.3 | 32.1 | 38.1 |
| % Detergency 240 ppm | 26.0 | 23.6 | 33.1 |
| Flow characteristics | X | K | A |
| % $H_2O$ in total weight | 18.5% | 10.2% | 10.6% |

Washing condition: D/C VCD cloth; 120° F; 60,120,240 ppm (2:1 $Ca^{++}/Mg^{++}$) water at a 0.2% product concentration (corrected to zero % water).

EXAMPLES 29–32

| Components | 29 | 30 | 31 | 32 |
|---|---|---|---|---|
| $CaC_{12-14}$Alcohol Sulfate | — | 12.0% | 8.0% | 20.0% |
| Neodol 25-7 | 20.0% | 8.0% | 12.0% | — |
| Ru Silicate | 10.0% | 10.0% | 10.0% | 10.0% |
| Na Tripolyphosphate | 33.0% | 33.0% | 33.0% | 33.0% |
| $Na_2SO_4$ | balance | balance | balance | balance |
| % Detergency 60 ppm | 36.7 | 38.8 | 38.1 | 34.4 |
| % Detergency 120 ppm 0.1% | 31.6 | 33.3 | 35.5 | 20.5 |
| % Detergency 240 ppm | 26.7 | 27.5 | 27.9 | 14.6 |
| % Detergency 60 ppm | 40.5 | 40.5 | 40.5 | 42.5 |
| % Detergency 120 ppm 0.2% | 38.6 | 41.7 | 40.5 | 40.4 |
| % Detergency 240 ppm | 34.8 | 37.8 | 35.7 | 38.1 |
| Flow characteristics | K | A | F | A |
| % $H_2O$ in total weight | 10.2% | 11.4% | 11.0% | 12.1% |

Washing conditions: D/C VCD cloth: 120° F; 60,120,240 ppm (2:1 $Ca^{++}/Mg^{++}$) water at both a 0.1% and 0.2% product concentration (corrected to zero % water).

EXAMPLES 33–36

| Components | 33 | 34 | 35 | 36 |
|---|---|---|---|---|
| $CaC_{12-14}$Alcohol Sulfate | — | 12.0% | 8.0% | 20.0% |
| Na Tripolyphosphate | 33.0% | 33.0% | 33.0% | 33.0% |
| $Na_2SO_4$ | 37.0% | 34.4% | 35.28% | 32.64% |
| Ru Silicate | 10.0% | 10.0% | 10.0% | 10.0% |
| Neodol 25-7 | 20.0% | 8.0% | 12.0% | — |

-continued

| Components | 33 | 34 | 35 | 36 |
|---|---|---|---|---|
| % $H_2O$ in total weight | 10.2% | 11.4% | 11.0% | 12.1% |
| 0.1% % Detergency 60 ppm | 29.3 | 33.0 | 34.8 | 28.5 |
| 0.1% % Detergency 120 ppm | 24.1 | 22.0 | 25.1 | 11.5 |
| 0.1% % Detergency 240 ppm | 20.8 | 23.5 | 24.5 | 8.5 |
| 0.2% % Detergency 60 ppm | 36.0 | 35.6 | 37.6 | 35.6 |
| 0.2% % Detergency 120 ppm | 36.7 | 37.3 | 36.5 | 34.8 |
| 0.2% % Detergency 240 ppm | 26.3 | 29.7 | 28.4 | 18.2 |
| Flow characteristics | slurry | tacky bead free-flowing | wet bead creepy | dry bead free-flowing |
| | K | V | Z | M |

Washing conditions: All products evaluated at both 0.1% and 0.2% product concentration; 80° F; 60,120,240ppm (2:1 $Ca^{++}/Mg^{++}$) water, on D/C VCD cloth.

EXAMPLES 37–44

| Components | 37 | 38 | 39 | 40 | 41 | 42 | 43 | 44 |
|---|---|---|---|---|---|---|---|---|
| $CaC_{16-18}$Alcohol Sulfate | 12.0% | 12.0% | 9.0% | 9.0% | 12.0% | 12.0% | 9.0% | 9.0% |
| Neodol 25-7 | 8.0% | 8.0% | 6.0% | 6.0% | 8.0% | 8.0% | 6.0% | 6.0% |
| Na Tripolyphosphate | 25.0% | 33.0% | 25.0% | 33.0% | — | — | — | — |
| Tetrasodium pyrophosphate | — | — | — | — | 25.0% | 33.0% | 25.0% | 33.0% |
| Ru Silicate Solids | 10.0% | 10.0% | 10.0% | 10.0% | 10.0% | 10.0% | 10.0% | 10.0% |
| $Na_2SO_4$ | balance | balance | balance | balance | balance | balance | balance | balance |
| % Detergency 60 ppm | 38.6 | 40.9 | 38.7 | 40.5 | 36.5 | 39.1 | 39.3 | 41.8 |
| % Detergency 120 ppm | 37.2 | 35.7 | 35.7 | 35.1 | 34.6 | 36.9 | 34.8 | 39.0 |
| % Detergency 240 ppm | 31.6 | 32.9 | 31.5 | 29.7 | 34.2 | 35.5 | 36.1 | 36.3 |
| Flow characteristics | B F | C F | A F | D F | G | G | G | G |
| % $H_2O$ in total weight | 10.6% | 10.6% | 10.4% | 10.5% | 10.6% | 10.6% | 10.5% | 10.5% |

Washing conditions: D/C VCD cltoh; 120° F; 60,120,240 ppm (2:1 $Ca^{++}/Mg^{++}$) water; at 0.2% product concentration (corrected to zero % water).
A - Dry free flowing dusty
B - Dry free flowing no dust
C - Tacky mostly free flowing
D - Very dusty free flowing bead
E - Damp partially free flowing bead - compressible
F - Compressible
G - Free flowing large bead - compressible

What is claimed is:

1. A mechanically mixed, non-spray dried, powdered laundry detergent composition comprising:

(a) from about 4 to about 20 weight percent of the calcium salt of a non-soap, organic, anionic surfactant;

(b) from about 4 to about 20 weight percent of an ethoxylated alcohol nonionic surfactant; and (c) from about 5 to about 70 weight percent of an alkali metal salt of a phosphate sequestering builder compound;

the percentages being based on the total weight of the composition.

2. The composition of claim 1 wherein component (a) is present in an amount of from about 8 to about 12 weight percent.

3. The composition of claim 1 wherein component (b) is present in an amount of from about 8 to about 12 weight percent.

4. The composition of claim 1 wherein the ratio of component (a) to component (b) is from about 2.5–4.0:2.0.

5. The composition of claim 1 wherein component (c) is present in an amount of from about 10 to about 60 weight percent.

6. The composition of claim 1 wherein component (c) is present in an amount of from about 25 to about 50 weight percent.

7. The composition of claim 1 wherein component (a) is a calcium alkyl sulfate having 8 to 22 carbon atoms, a calcium linear alkane sulfonate having 8 to 24 carbon atoms, a calcium olefin sulfonate having 10 to 24 carbon atoms, a calcium linear alkylbenzene sulfonate, or a calcium alcohol ethoxy (1–6EO) sulfate, or mixtures thereof.

8. The composition of claim 7 wherein component (a) is a calcium alkyl sulfate having 8 to 22 carbon atoms.

9. The composition of claim 8 wherein component (a) is a calcium $C_{12}$–$C_{14}$ alkyl sulfate.

10. The composition of claim 8 wherein component (a) is a calcium $C_{14}$ alkyl sulfate.

11. The composition of claim 7 wherein component (a) is a calcium linear alkane sulfonate having 8 to 24 carbon atoms.

12. The composition of claim 11 wherein component (a) is a calcium linear alkane sulfonate containing 12 to 20 carbon atoms.

13. The composition of claim 11 wherein component (a) is a calcium linear alkane sulfonate containing 11 to 18 carbon atoms.

14. The composition of claim 7 wherein component (a) is a calcium olefin sulfonate having 10 to 24 carbon atoms.

15. The composition of claim 14 wherein component (a) is a calcium olefin sulfonate having 14 to 16 carbon atoms.

16. The composition of claim 1 wherein component (b) is a nonionic surfactant of the ethoxylated alcohol type having the formula $$RO(C_2H_4O)_nH$$

wherein R is an alkyl, alkenyl or alkaryl group having 8 to 20 carbon atoms; and $n$ is an integer from 4 to 30.

17. The composition of claim 16 wherein component (b) is a linear $C_{12}$–$C_{15}$ primary alcohol condensed with 7 moles of ethylene oxide per mole of alcohol.

18. The composition of claim 16 wherein component (b) is a random $C_{11}$–$C_{15}$ alcohol condensed with 7 moles of ethylene oxide per mole of alcohol.

19. The composition of claim 16 wherein component (b) is a primary $C_{14}$–$C_{16}$ alcohol condensed with 6.5 moles of ethylene oxide per mole of alcohol.

20. The composition of claim 1 wherein component (c) is an alkali metal tripolyphosphate or pyrophosphate, or mixtures thereof.

21. The composition of claim 20 wherein the alkali metal is sodium or potassium.

22. The composition of claim 20 wherein component (c) is sodium or potassium tripolyphosphate.

23. The composition of claim 20 wherein component (c) is sodium or potassium pyrophosphate.

24. The composition of claim 1 wherein the composition additionally comprises from about 5 to about 15 weight percent of a non-phosphorous sequestering builder compound.

25. A mechanically mixed, non-spray dried, powdered laundry detergent composition comprising:

(a) from about 8 to about 12 weight percent of (i) a calcium alkyl sulfate containing 8 to 22 carbon atoms; (ii) a calcium linear alkane sulfonate containing 8 to 24 carbon atoms; (iii) a calcium olefin sulfonate containing 10 to 24 carbon atoms; (iv) a calcium linear alkylbenzene sulfonate; or (v) a calcium alcohol ethoxy (1-6EO) sulfate; or mixtures thereof;

(b) from about 8 to 12 weight percent of nonionic surfactant having the formula $$RO(C_2H_4O)_nH$$

wherein R is an alkyl, alkenyl, or alkaryl group containing 8 to 20 carbon atoms; and $n$ is an integer from 4 to 30; and (c) from about 25 to about 50 weight percent of sodium or potassium tripolyphosphate or pyrophosphate;

the percentages being based on the total weight of the composition.

* * * * *